US011785385B2

(12) United States Patent
Konagai

(10) Patent No.: US 11,785,385 B2
(45) Date of Patent: Oct. 10, 2023

(54) SHOULDER-MOUNTED SPEAKER, SOUND IMAGE LOCALIZATION METHOD, AND NON-TRANSITORY COMPUTER-READABLE MEDIUM

(71) Applicant: Yamaha Corporation, Shizuoka (JP)

(72) Inventor: Yusuke Konagai, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 17/592,487

(22) Filed: Feb. 3, 2022

(65) Prior Publication Data

US 2022/0256287 A1 Aug. 11, 2022

(30) Foreign Application Priority Data

Feb. 9, 2021 (JP) ..... 2021-019091

(51) Int. Cl.

| | |
|---|---|
| ***H04R 5/02*** | (2006.01) |
| ***H04R 3/12*** | (2006.01) |
| ***H04R 1/40*** | (2006.01) |
| ***H04R 1/02*** | (2006.01) |

(52) U.S. Cl.

CPC ..... *H04R 5/02* (2013.01); *H04R 1/026* (2013.01); *H04R 1/403* (2013.01); *H04R 3/12* (2013.01)

(58) Field of Classification Search

CPC ..... H04R 5/02; H04R 1/026; H04R 1/403; H04R 3/12

See application file for complete search history.

(56) References Cited

U.S. PATENT DOCUMENTS

| | | | | |
|---|---|---|---|---|
| 11,259,112 | B1 * | 2/2022 | Marti | H04R 3/00 |
| 2018/0041837 | A1 * | 2/2018 | Woelfl | H04R 3/12 |

FOREIGN PATENT DOCUMENTS

| | | | |
|---|---|---|---|
| JP | 2671327 | * | 10/1997 |
| JP | 2018023104 | A | 2/2018 |
| WO | 2017135063 | A1 | 8/2017 |

OTHER PUBLICATIONS

Machine translation of JP2671327; Inanaga et al., Oct. 29, 1997.*

* cited by examiner

*Primary Examiner* — Andrew L Sniezek
(74) *Attorney, Agent, or Firm* — Global IP Counselors, LLP

(57) ABSTRACT

A shoulder-mounted speaker comprises an electronic controller including at least one processor. The electronic controller is configured to execute a plurality of modules including an attitude data detection module that is configured to detect an attitude of a body region on which the shoulder-mounted speaker is placed and is configured to acquire body region attitude data obtained by digitizing the attitude of the body region, an attitude data correction module that is configured to correct the acquired body region attitude data so as to be head attitude data, and a sound image localization processing module that is configured to use a head-related transfer function that corresponds to the head attitude data corrected by the attitude data correction module to subject an audio signal to sound image localization processing.

13 Claims, 16 Drawing Sheets ta1

| TILT ANGLE OF THE SHOULDERS | HEAD ANGLE |
|---|---|
| a1 | b1 |
| a2 | b2 |
| ⋮ | ⋮ |

FIG. 7 p1

| TILT ANGLE OF THE SHOULDERS | HEAD ANGLE |
|---|---|
| a1 | b1 |
| a2 | b2 |
| ⋮ | ⋮ |

p2

| TILT ANGLE OF THE SHOULDERS | HEAD ANGLE |
|---|---|
| a1 | c1 |
| a2 | c2 |
| ⋮ | ⋮ |

p3

| TILT ANGLE OF THE SHOULDERS | HEAD ANGLE |
|---|---|
| a1 | d1 |
| a2 | d2 |
| ⋮ | ⋮ |

FIG. 10 ta1

| TILT ANGLE OF THE SHOULDERS | HEAD ANGLE |
|---|---|
| a1 | b1 |
| a2 | b2 |
| ⋮ | ⋮ |

ta2

| TILT ANGLE OF THE SHOULDERS | HEAD ANGLE |
|---|---|
| ay1 | by1 |
| ay2 | by2 |
| ⋮ | ⋮ |

ta3

| TILT ANGLE OF THE SHOULDERS | HEAD ANGLE |
|---|---|
| ax1 | bx1 |
| ax2 | bx2 |
| ⋮ | ⋮ |

FIG. 14

SHOULDER-MOUNTED SPEAKER, SOUND IMAGE LOCALIZATION METHOD, AND NON-TRANSITORY COMPUTER-READABLE MEDIUM

CROSS-REFERENCE TO RELATED APPLICATIONS

This application claims priority to Japanese Patent Application No. 2021-19091 filed in Japan on Feb. 9, 2021. The entire disclosure of Japanese Patent Application No. 2021-19091 is hereby incorporated herein by reference.

BACKGROUND

Field of the Invention

This invention generally relates to a speaker that is used while placed on the shoulders of a user.

Background Information

The wearable speaker device of Japanese Patent Application Publication No. 2018-023104 (Patent Document 1) is used while placed on the shoulders of a user. In the wearable speaker device of Patent Document 1, a transfer function between a speaker and the user's ears, for example, is corrected in accordance with the distance between a sensor and part of the user's head (for example, the ears) detected by the sensor, and thereby suppress changes in tone caused by movements of the head. In addition, an audio processing device (for example, headphones) that controls the sound image using a head-related transfer function (HRTT) as a method of simulating stereophonic sound at the ears is known from the prior art (for example, International Publication No. 2017/135063 (Patent Document 2)). The audio processing device of Patent Document 2 performs head-tracking and sequentially reads the required HRTF from an HRTF database of the entire surroundings and thereby performs sound image localization.

SUMMARY

In the wearable speaker device of Patent Document 1, the sound image is at the position of the speaker irrespective of the attitude of the head. In addition, the audio processing device of Patent Document 2 requires a sensor for detecting the attitude of the head. Whereas it is possible to detect the attitude of the head with a sensor in headphones that are worn on the head, as in Patent Document 2, because shoulder-mounted speakers, such as in Patent Document 1, are not worn on the head, the attitude of the head cannot be detected using a sensor. Therefore, it is difficult to achieve sound image localization as in Patent Document 2 with shoulder-mounted speakers.

An object is to achieve a sound image localization in an appropriate position in accordance with the attitude of the head even if the attitude of the head cannot be detected, such with a shoulder-mounted speaker.

In view of the state of the known technology, a shoulder-mounted speaker is provided that comprises an electronic controller including at least one processor. The electronic controller is configured to execute a plurality of modules including an attitude data detection module that is configured to detect an attitude of a body region on which the shoulder-mounted speaker is placed and is configured to acquire body region attitude data obtained by digitizing the attitude of the body region, an attitude data correction module that is configured to correct the acquired body region attitude data so as to be head attitude data, and a sound image localization processing module that is configured to use a head-related transfer function that corresponds to the head attitude data corrected by the attitude data correction module to subject an audio signal to sound image localization processing.

A shoulder-mounted speaker, a sound image localization method, and a sound image localization program can realize sound image localization in an appropriate position in accordance with the attitude of the head, even if the attitude of the head cannot be detected, such as with a shoulder-mounted speaker.

BRIEF DESCRIPTION OF THE DRAWINGS

FIG. 7 is a table showing the relationship between a tilt angle of the shoulders and a head angle.

FIG. 10 is a plurality of tables showing the relationship between the tilt angle of the shoulders and the head angle.

FIG. 14 is a plurality of tables showing the relationships between the tilt angle of the shoulders and the head angle in three directions.

DETAILED DESCRIPTION OF EMBODIMFNTS

Figure 1:
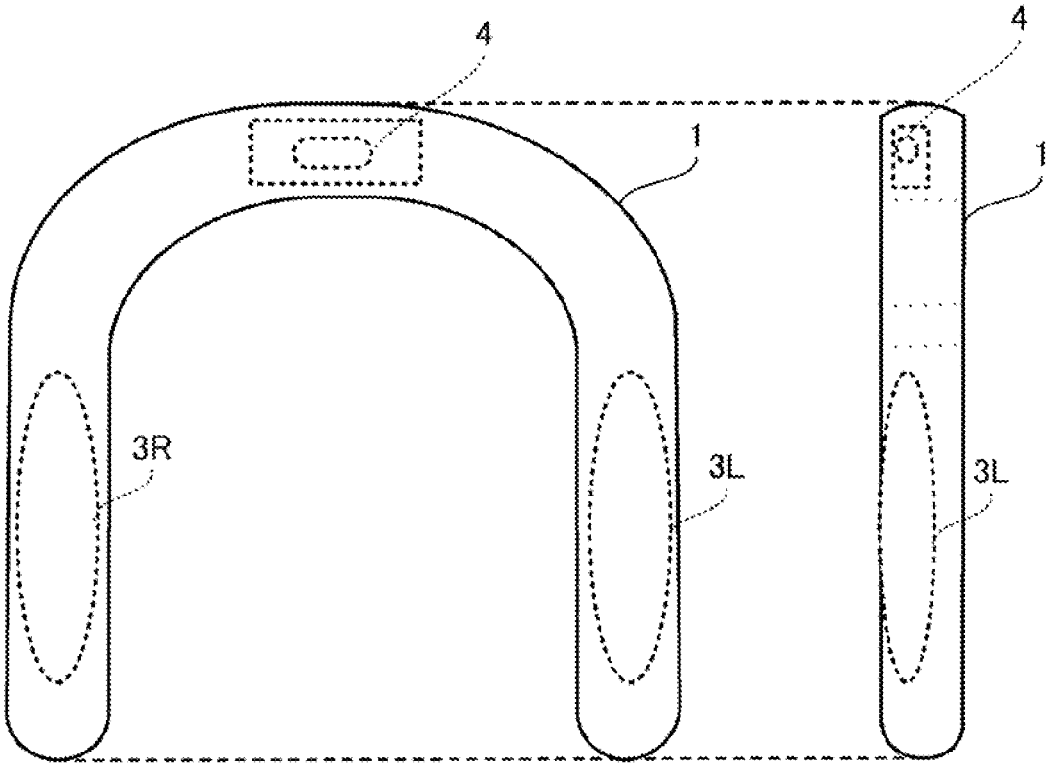
FIG. 1 is a plan view and a side view showing the appearance of a shoulder-mounted speaker.
Figure 2:
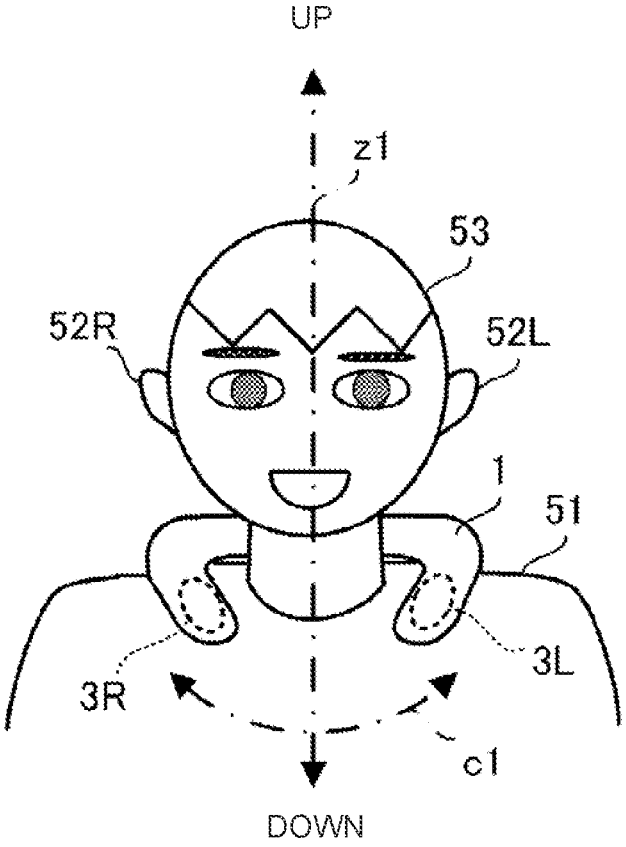
FIG. 2 is an explanatory diagram showing a state in which a user is wearing a shoulder-mounted speaker.

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents. A shoulder-mounted speaker 1 according to the present embodiment will be described with reference to the drawings. FIG. 1 shows a plan view and a side view of the appearance of the shoulder-mounted speaker 1. FIG. 2 is an explanatory diagram showing the state in which a user is wearing the shoulder-mounted speaker 1. As shown in FIG. 1, when seen in a plan view (orthogonally from above), the shoulder-mounted speaker 1 is U-shaped and is in the form of an arc-shaped arcuate part, with long portions that extend from the two ends of the arcuate part. The shoulder-mounted speaker 1 is worn such that the arcuate part follows the rear side of the user's neck, as shown in FIG. 2. In addition, the shoulder-mounted speaker 1 is hung across the shoulders 51 such that the two long portions extend forward from the user's shoulders 51.

As shown in FIG. 1, the shoulder-mounted speaker 1 contains speakers 3L, 3R installed in the housing of each of the long portions. The user wears the shoulder-mounted speaker 1 such that the sound-emitting portions of the speakers 3L, 3R face upwards. More specifically, the user wears the shoulder-mounted speaker such that the speaker 3L is disposed to the side of the user's left ear 52L. Also, the user wears the shoulder-mounted speaker such that the speaker 3R is disposed to the side of the user's right ear 52R (refer to FIG. 2).

The shoulder-mounted speaker 1 contains a sensor 4 and an electronic circuit other than the sensor 4, etc., in the housing of the arcuate part. The sensor 4 need not be installed in the housing of the shoulder-mounted speaker 1. The sensor 4 can be provided outside of the housing of the shoulder-mounted speaker 1, for example.

The shoulder-mounted speaker 1 receives audio signals from, for example, a mobile terminal (smartphone, PC, etc.) or a TV. The shoulder-mounted speaker 1 subjects the received audio signals to signal processing. Sound based on the signal-processed audio signals are emitted from the speakers 3L, 3R of the shoulder-mounted speaker 1.

The shoulder-mounted speaker 1 in this example receives stereo channel audio signals, for example. For example, the shoulder-mounted speaker 1 upmixes the received stereo-channel audio signal into a 5-channel audio signal. In this example, five channels mean front left FL, center C, front right FR, surround left SL, and surround right SR.

The shoulder-mounted speaker 1 subjects the 5-channel audio signal upmixed from the stereo channels to sound image localization processing. More specifically, the shoulder-mounted speaker 1 generates, from the position of the sound image for each channel, an audio signal obtained by convolving a head-related transfer function for the left ear 52L (L-channel signal) and an audio signal obtained by convolving a head-related transfer function for the right ear 52R (R-channel signal).

The shoulder-mounted speaker 1 carries out a sound image localization process in accordance with the head attitude data, so that the position of the sound image does not change, even if the attitude of the user's head 53 changes.

Figure 3:
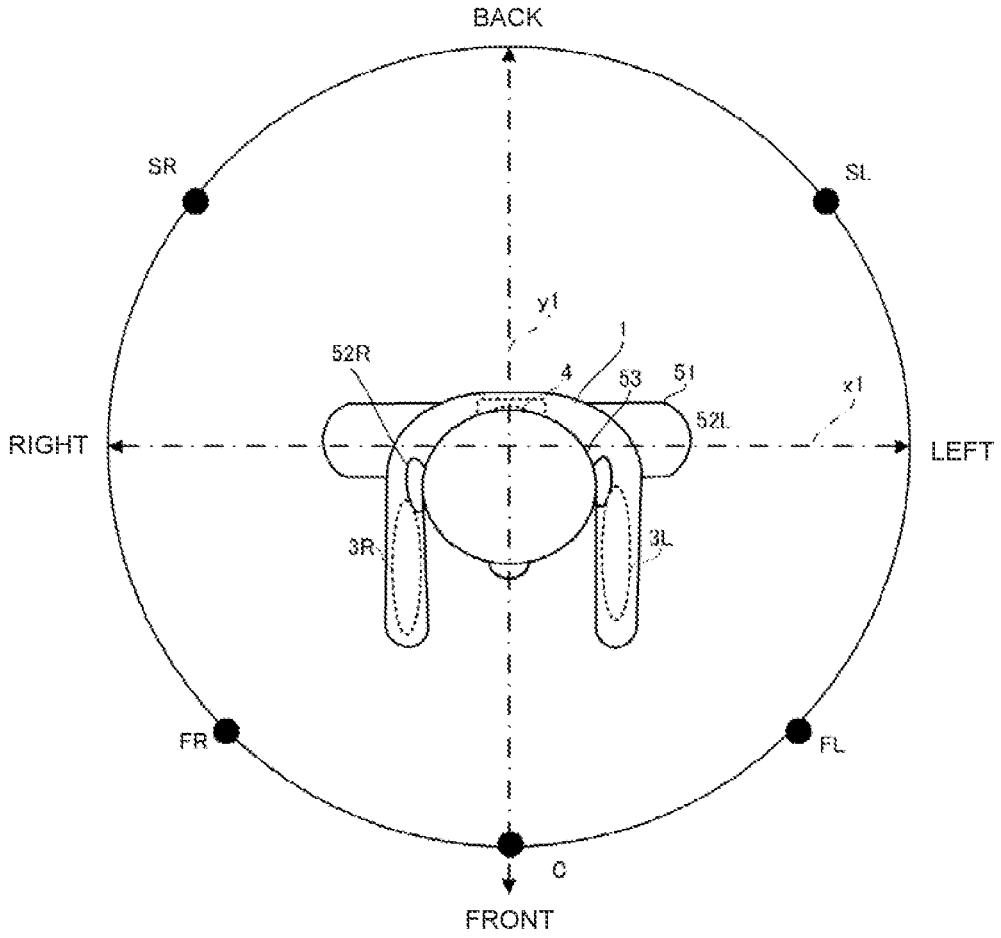
FIG. 3 is a plan view showing the positions of a 5-channel sound image.

FIG. 3 is a plan view showing the positions of a 5-channel sound image. The head-related transfer function is from the sound source to the user's head 53 (specifically, the user's left ear 52L and right ear 52R). As shown in FIG. 3, the head-related transfer function is a transfer function representing two transfer paths that are at a prescribed distance from the user, for example 1 m, and that reach the user's left ear 52L and right ear 52R with respect to each of the five channels (front left FL, center C, front right FR, surround left SL, and surround right SR). In this example, when the user is seen orthogonally from above, of the five channels, the sound image of the front left FL is localized at the front left of the user, the center C is localized in front of the user, the sound image of the front right FR is localized at the front right of the user, the sound image of the surround left SL is localized at the rear left of the user, and the sound image of the surround right SR is localized at the rear right of the user.

Here, the shoulder-mounted speaker 1 acquires the attitude of the head 53 to perform the sound image localization process using the head-related transfer function. The shoulder-mounted speaker 1 corrects the attitude of the shoulders 51 (tilt angle) so as to be the attitude of the head 53 (angle). In other words, the shoulder-mounted speaker 1 detects the angle at which the shoulders 51 are tilted and acquires the head angle from the detected tilt angle of the shoulders, rather than detecting the attitude of the head 53 directly. The tilt angle of the shoulders in this example is one example of the body region attitude data of the present invention. In addition, the head angle in this example is one example of the head attitude data of the present invention.

Figure 4:
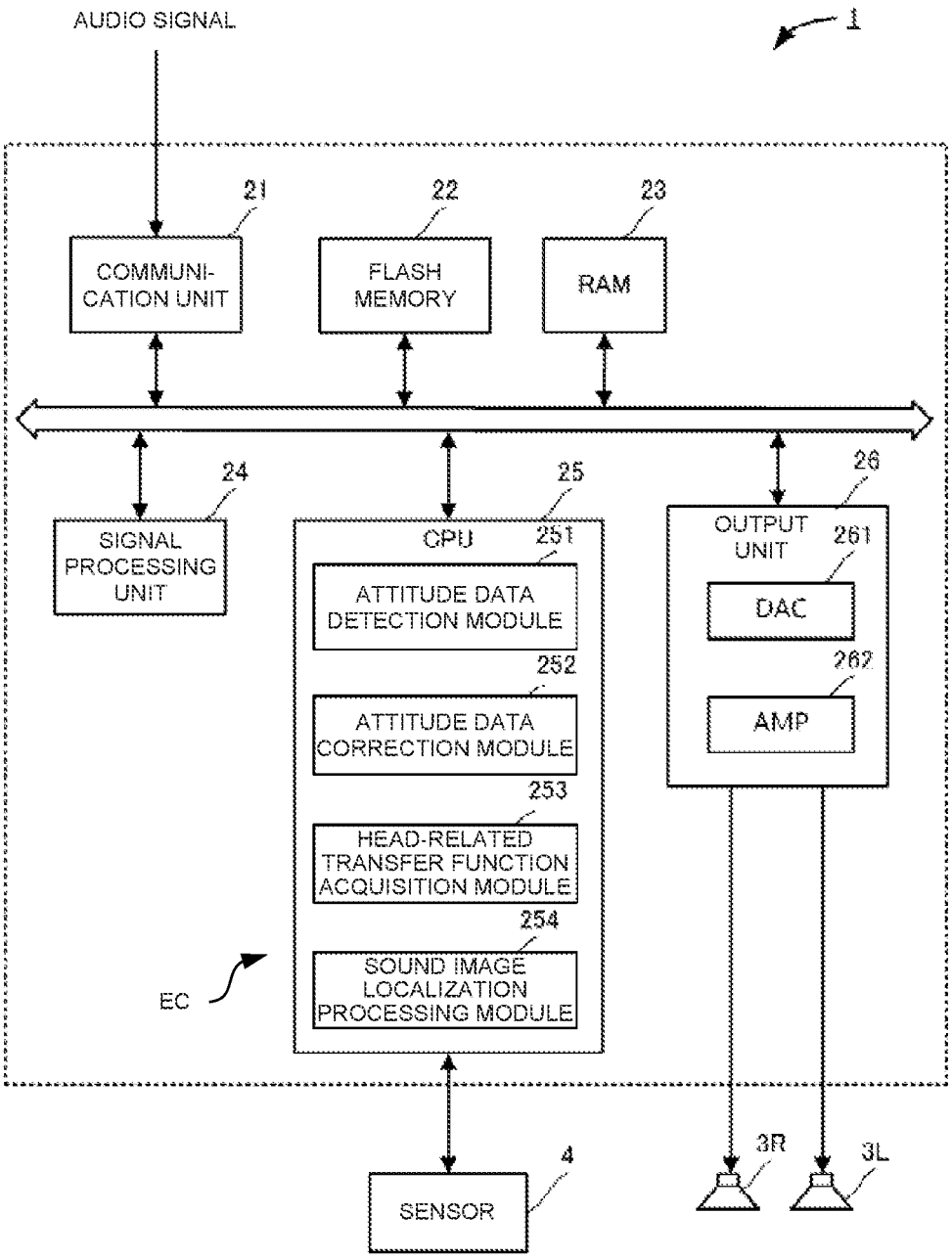
FIG. 4 is a block diagram showing one example of a configuration of the shoulder-mounted speaker.

The configuration of the shoulder-mounted speaker 1 will be described with reference to FIG. 4. FIG. 4 is a block diagram showing one example of the configuration of the shoulder-mounted speaker 1. The shoulder-mounted speaker 1 comprises a communication unit or communicator 21, a flash memory 22, a RAM 23, a signal processing unit or signal processor 24, an electronic controller EC with a CPU 25, an output unit or output interface 26, the speakers 3L, 3R, and the sensor 4.

The communication unit 21 receives an audio signal from a mobile terminal or a TV, for example. The communication unit 21 is a hardware device capable of receiving an analog or digital audio signal wirelessly, and can be a wireless communicator. The term "wireless communicator" as used herein can include a receiver, a transmitter, a transceiver, a transmitter-receiver, and contemplates any device or devices, separate or combined, capable of transmitting and/or receiving wireless communication signals. The wireless communication signals can be radio frequency (RF) signals having a frequency that is in a 2.4 GHz band or a 5.0 GHz band, ultra-wide band communication signals, or Bluetooth® communications or any other type of signal suitable for short range wireless communications as understood in the shoulder-mounted speaker field. However, the communication unit 21 can be a one-way communication device such as a receiver or tuner if the audio signal only needs to be wirelessly inputted from the mobile terminal or the TV. Of course, the communication unit 21 can be a communication interface that can receive the audio signal through a wired connection via an audio cable.

The signal processing unit 24 includes one or more processor, such as a DSP (Digital Signal Processing or Processor), for example. The signal processing unit 24 subjects the received audio signal to signal processing. In this example, the signal processing unit 24 upmixes the received stereo audio signal to five channels.

A table ta1 (refer to FIG. 7) showing the relationship between the tilt angle of the shoulders and the head angle is stored in the flash memory 22. A detailed description of the table ta1 will be provided below. The head-related transfer function for each of the five channels is also stored in the flash memory 22.

The electronic controller EC includes one or more processor, such as the CPU 25. The term "electronic controller" as used herein refers to hardware that executes a software program, and does not include a human. The electronic controller EC can be configured to comprise, instead of the CPU 25 or in addition to the CPU 25, programmable logic devices such as a DSP (Digital Signal Processing or Processor), an FPGA (Field Programmable Gate Array), and the like. In addition, the electronic controller EC can include a plurality of CPUs (or a plurality of programmable logic devices). The CPU 25 reads an operating program stored in the flash memory 22 into the RAM 23 and integrally controls the shoulder-mounted speaker 1. In addition, the CPU 25 includes or executes an attitude data detection module 251, an attitude data correction module 252, a head-related transfer function acquisition module 253, and a sound image localization processing module 254. The CPU 25 executes an application program and reads a program from the flash memory 22 related to an attitude data detection process, an attitude data correction process, a head-related transfer function acquisition process, and a sound image localization process into the RAM 23. Thus, the CPU 25 configures the attitude data detection module 251, the attitude data correction module 252, the head-related transfer function acquisition module 253, and the sound image localization processing module 254. Detailed descriptions of the attitude data detection module 251, the attitude data correction module 252, the head-related transfer function acquisition module 253, and the sound image localization processing module 254 will be provided below.

The program read by the CPU 25 need not be stored in the flash memory 22 of the shoulder-mounted speaker 1. For example, the program can be stored in a storage medium of an external device, such as a server. In this case, the CPU 25 can read the program from the server (not shown) into the RAM 23 and execute the program each time. In any case, the program can be stored in any computer storage device or any computer readable medium, which can be nonvolatile memory or volatile memory, with the sole exception of a transitory, propagating signal. In particular, the program is stored in a non-transitory computer-readable medium and causes the CPU 25 to execute a sound image localization process or method.

The output unit 26 is an output interface that is connected to the speakers 3L, 3R The term "output interface" as used herein refers to hardware, and does not include a human. The output unit 26 outputs the signal-processed audio signal to the speakers 3L, 3R The output unit 26 has a D/A converter (hereinafter referred to as DAC) 261, and an amplifier (hereinafter referred to as AMP) 262. The DAC 261 converts signal-processed digital signals into analog signals. The AMP 262 amplifies said analog signals to drive the speakers 3L, 3R The output unit 26 outputs the amplified analog signals (audio signals) to the speakers 3L, 3R.

The speakers 3L, 3R emit sound based on the audio signals output from the output unit 26.

The sensor 4 is, for example, an angular velocity sensor and is provided at the center of the arcuate part of the housing. The sensor 4 is, for example, an angular velocity sensor that detects the angular velocity in horizontal direction or plane c1 about an axis along the vertical direction (direction z1). In this example, the shoulders 51 is the body region on which the shoulder-mounted speaker 1 is mounted.

Figure 5:
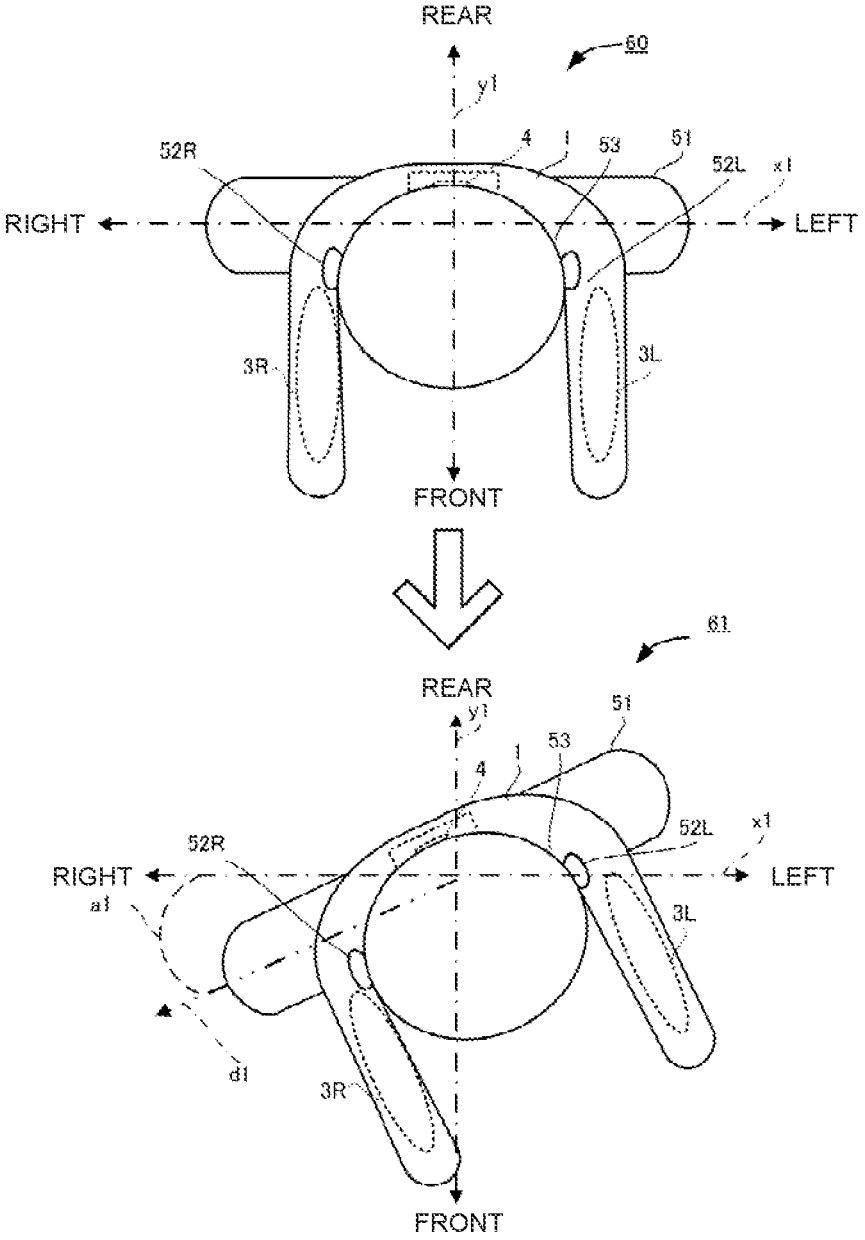
FIG. 5 is a plan view of the shoulder-mounted speaker as seen from above, showing a change in the user's state.

FIG. 5 is a plan view of the shoulder-mounted speaker as seen from above, and shows a change in state (from state 60 to state 61) of the user wearing the shoulder-mounted speaker 1. Direction y1, designated by the dashed-dotted line in FIG. 5, is the front-rear direction, where the upward side in the plane of the paper indicates the rear side of the user, and the downward side in the plane of the paper indicates the front side of the user. Direction x1 designated by the dashed-dotted line in FIG. 5 is the left-right direction, where the right side in the plane of the paper indicates the left side of the user, and the left side in the plane of the paper indicates the right side of the user.

As shown in FIG. 5, state 60 (state of the user at the top of the plane of the paper in FIG. 5) indicates a forward (front)-facing state of the user. Also, state 61 (user state at the bottom of the plane of the paper in FIG. 5) indicates a leftward-facing state of the user. Using the right side as a reference, the position of the shoulders 51 in state 61 is tilted relative to the position of the shoulders 51 in state 60 at a shoulder tilt angle a1.

Figure 6:
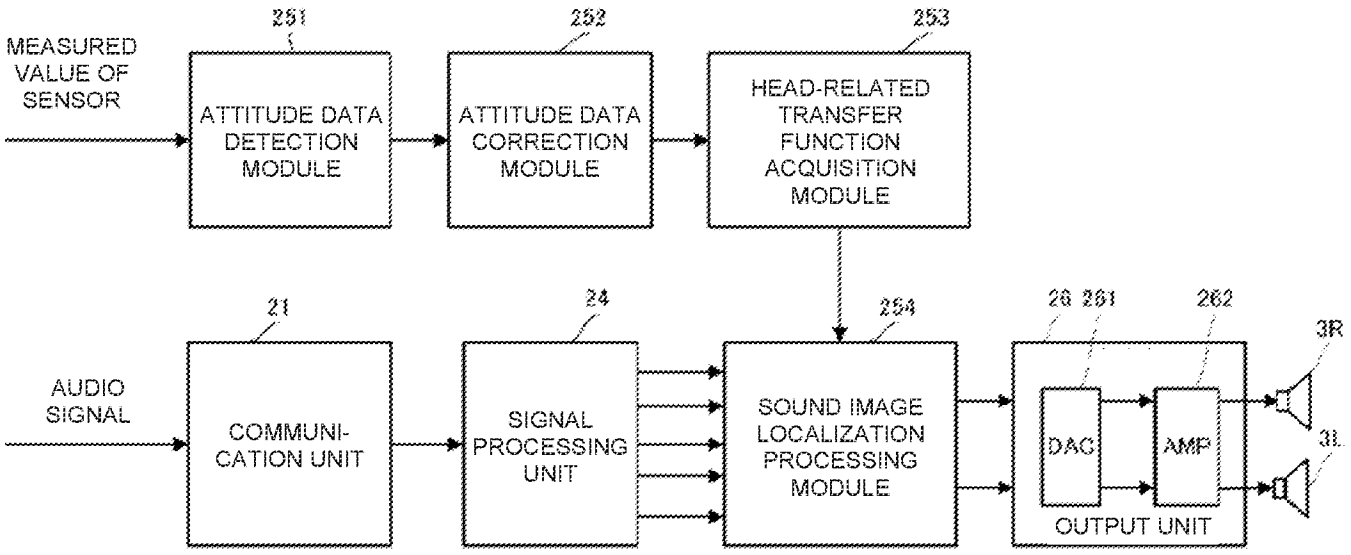
FIG. 6 is an explanatory diagram showing one example of the flow of a signal input to the shoulder-mounted speaker.

The attitude data detection module 251, the attitude data correction module 252, the head-related transfer function acquisition module 253, and the sound image localization processing module 254 will be described with reference to FIGS. 6 and 7. FIG. 6 is an explanatory diagram showing one example of the flow of a signal input to the shoulder-mounted speaker 1. FIG. 7 is a table showing the relationship between the tilt angle of the shoulders and the head angle.

As shown in FIG. 6, the attitude data detection module 251 detects the attitude of the shoulders 51 from a measurement value output by the sensor 4. Based on the angular velocity detected by the sensor 4, the attitude data detection module 251 calculates shoulder tilt angle a1 (refer to FIG. 5). More specifically, in the case that the orientation of the shoulders tilts from the right side direction toward the direction indicated by the chain double-dashed line d1 shown in FIG. 5, the attitude data detection module 251 detects shoulder tilt angle a1. The attitude data detection module 251 outputs the calculated shoulder tilt angle a1 to the attitude data correction module 252.

Based on table ta1 shown in FIG. 7, the attitude data correction module 252 corrects shoulder tilt angle a1 (body region attitude data) so as to be the head angle (head attitude data). That is, the attitude data correction module 252 references table ml pre-stored in the flash memory 22 and acquires the head angle that corresponds to shoulder tilt angle a1 output from the attitude data detection module 251. For example, in the case of shoulder tilt angle a1 shown in FIG. 7, the attitude data correction module 252 acquires from table ta1 head angle b1 that corresponds to shoulder tilt angle a1.

Table ta1 shows, for example, the mean values of a large amount of collected measurement data. Measurement data are measurements of the tilt angle of the shoulders of a sitting person and the head angle that corresponds to the shoulder tilt angle. Table ta1 can be generated using a machine-learned algorithm (for example, a neural network). An algorithm for calculating the head angle from the tilt angle of the shoulders is constructed, for example, by means of end-to-end learning using the aforementioned large amount of collected measurement data. In this case, the tilt angle of the user's shoulders becomes an element of the input data. And the head angle is an element of the output data. The algorithm outputs the head angle that corresponds to the tilt angle of the shoulders calculated from the sensor 4 of the shoulder-mounted speaker 1 and generates the table. The table is created in advance in this case as well.

The attitude data correction module 252 outputs acquired head angle b1 to the head-related transfer function acquisition module 253.

The head-related transfer function acquisition module 253 reads the head-related transfer function that corresponds to head angle b1 from the flash memory 22. The head-related transfer function acquisition module 253 outputs the read head-related transfer function to the sound image localization processing module 254. The head-related transfer function acquisition module 253 outputs the head-related transfer function of the L channel corresponding to the speaker 3L and the head-related transfer function of the R channel corresponding to the speaker 3R to the sound image localization processing module 254.

The head-related transfer function acquisition module 253 reads from the flash memory 22 the head-related transfer function that corresponds to the head angle such that the position of the sound image does not move. More specifically, if the head tilts from state 60 to state 61 by an angle of b1° (for example, 30° counterclockwise about an axis along the vertical direction), the head-related transfer function acquisition module 253 reads the head-related transfer function for the case of a tilt angle of b1° (30° angle) clockwise about an axis along the vertical direction. If the head tilts from state 60 to state 61 by an angle of b1° (for example, 30° counterclockwise about an axis along the vertical direction), the head-related transfer function acquisition module 253 can calculate the head-related transfer function for the case of a tilt angle of b1° (−30° angle) clockwise about an axis along the vertical direction, and correct the head-related transfer function stored in the flash memory 22.

The sound image localization processing module 254 convolves the head-related transfer function for the L channel and the head-related transfer function for the R channel with each of the audio signals that have been upmixed to five channels by the signal processing module 24. The sound image localization processing module 254 generates a 2-channel stereo audio signal from the 5-channel audio signal with which the head-related transfer functions have been convolved.

Figure 8:
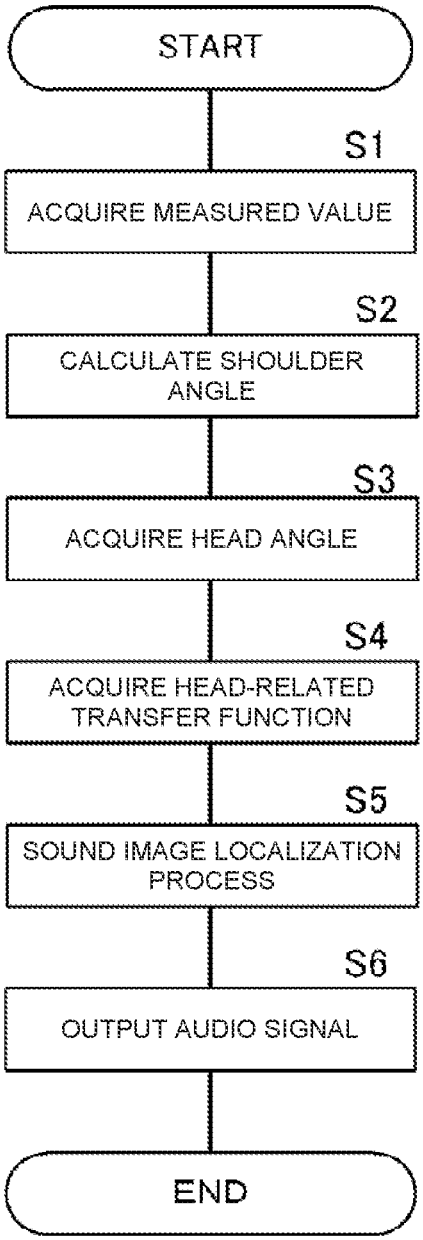
FIG. 8 is a flowchart showing one example of the operation of the shoulder-mounted speaker.

The operation of the shoulder-mounted speaker 1 (operation relating to sound image localization) will be described with reference to FIG. 8. FIG. 8 is a flowchart showing one example of the operation of the shoulder-mounted speaker 1.

The shoulder-mounted speaker 1 acquires the measured value of the sensor 4 (S1). The shoulder-mounted speaker 1 calculates shoulder tilt angle a1 from the measured value (S2). The shoulder-mounted speaker 1 uses table ta1 to correct shoulder tilt angle a1 so as to be head angle b1 (S3). In other words, the shoulder-mounted speaker 1 references table ta1 stored in the flash memory 22 and acquires head angle b1 corresponding to shoulder tilt angle a1. The shoulder-mounted speaker 1 acquires the head-related transfer function that corresponds to head angle b1 (S4). The shoulder-mounted speaker 1 convolves the head-related transfer function for the L channel and the head-related transfer function for the R channel with each of the audio signals of the upmixed five channels and thereby performs sound image localization processing (S5). The shoulder-mounted speaker 1 mixes the audio signals of each channel with which the head-related transfer functions have been convolved and outputs the audio signals as L-channel and R-channel audio signals (S6).

The shoulder-mounted speaker 1 according to the present embodiment acquires the head angle that corresponds to the shoulder tilt angle a1 from table ta1. In addition, the shoulder-mounted speaker 1 according to the present embodiment applies the head-related transfer function that corresponds to the acquired head angle to the audio signal of each channel and thereby performs sound image localization processing. As a result, the shoulder-mounted speaker 1 according to the present embodiment can perform sound image localization at the position of the sound image in accordance with the attitude of the head 53, even when the attitude of the head 53 cannot be detected directly. Therefore, the position of the sound image does not change even if the attitude of the use's head 53 changes.

The signal processing unit 24 is not limited to upmixing to five channels. The signal processing unit 24 can upmix to three channels, four channels, seven channels, nine channels, etc.

In the above-described embodiment, the shoulder-mounted speaker 1 upmixes 2-channel stereo audio signal to five channels, and head-related transfer functions are convolved with audio signals upmixed to five channels, but no limitation is implied. The shoulder-mounted speaker 1 can carry out a process to convolve head-related transfer functions with stereo audio signals without upmixing.

In addition, the communication unit 21 can receive a 5-channel audio signal. In this case, the signal processing unit 24 outputs an audio signal to the sound image localization processing unit 254 without upmixing.

MODIFIED EXAMPLE 1

Figure 9:
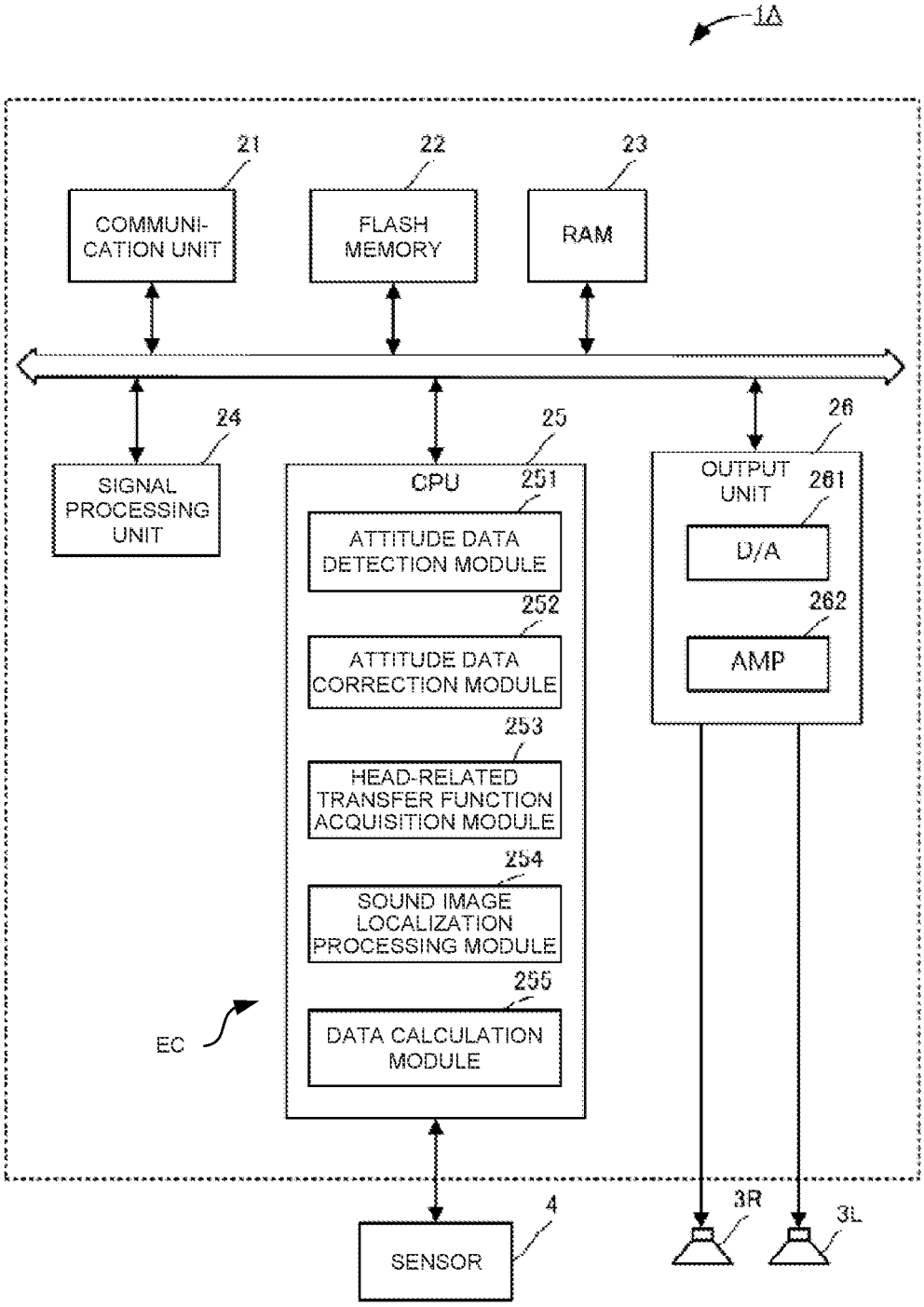
FIG. 9 is a block diagram showing the configuration of the shoulder-mounted speaker according to Modified Example 1.
Figure 11:
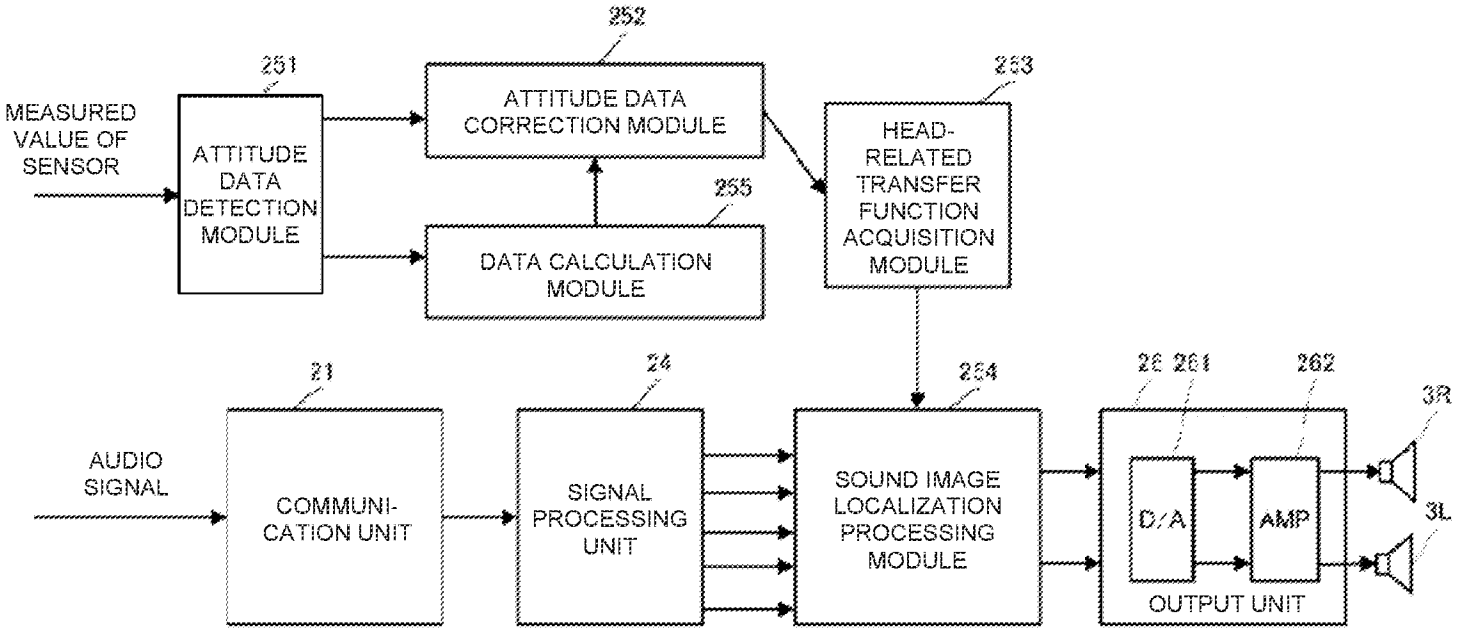
FIG. 11 is an explanatory diagram showing the flow of a signal input to the shoulder-mounted speaker according to the Modified Example 1.
Figure 12:
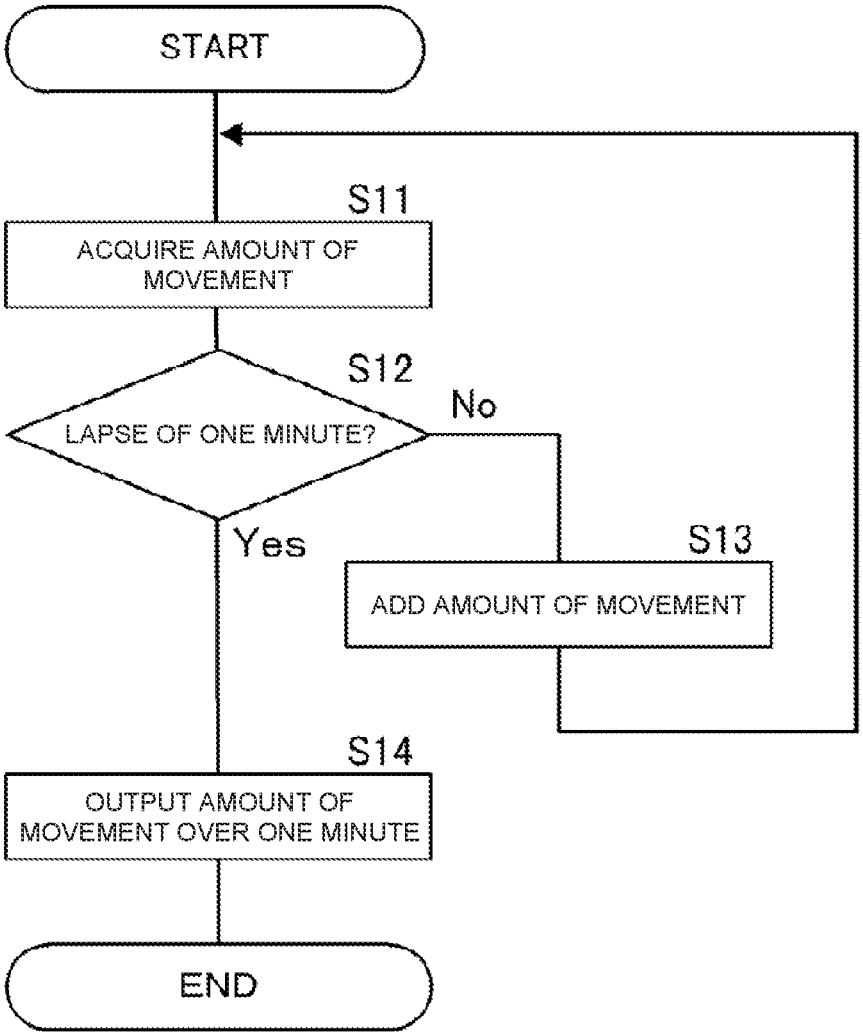
FIG. 12 is a flowchart showing one example of the operation of a data calculation module.

A shoulder-mounted speaker 1A of Modified Example 1 will be described with reference to FIGS. 9, 10, 11, and 12. FIG. 9 is a block diagram showing the configuration of the shoulder-mounted speaker 1A according to Modified Example 1. FIG. 10 is a plurality of tables p1, p2, p3 showing the relationship between the tilt angle of the shoulders and the head angle. FIG. 11 is an explanatory diagram showing the flow of a signal input to the shoulder-mounted speaker 1A according to the Modified Example 1. FIG. 12 is a flowchart showing one example of the operation of a data calculation module 255.

The configuration differs from the shoulder-mounted speaker 1 of the above-described embodiment in that the CPU 25 is equipped with the data calculation module 255 that calculates the angle of the user's shoulders per unit time from the angle of the shoulders 51 acquired by the attitude data detection module 251, as shown in FIG. 9. In addition, the shoulder-mounted speaker 1A differs from the shoulder-mounted speaker 1 described above in that the flash memory 22 stores a plurality (three in FIG. 10) of tables p1, p2, p3 that correspond to the angle of the shoulders per unit time. Tables p1, p2, p3 will be described further below.

The shoulder-mounted speaker 1A of Modified Example 1 also calculates the head angle from the tilt angle of the shoulders in the same manner as for the shoulder-mounted speaker 1 of the above-described embodiment. The head angle relative to the tilt angle of the shoulders 51 differs for each person. For example, a person that makes small movements will have a smaller head angle with respect to the tilt angle of the shoulders 51 than a person that makes large movements. The magnitude of movement is obtained by totaling the tilt angles of the shoulders (amount of movement) per unit time (for example, one minute). For example, a person that makes small movements will have a small tilt angle of the shoulders per unit time. In addition, a person that makes large movements has a large tilt angle of the shoulders per unit time.

Thus, the shoulder-mounted speaker 1A calculates the sum of the tilt angles of the shoulders 51 per unit time, e.g., for one minute, as the amount of movement. The shoulder-mounted speaker 1A selects a table with a pattern that corresponds to the amount of movement and corrects the tilt angle of the shoulders 51 (for example, the shoulder tilt angle a1 shown in FIG. 5) so as to be the head angle. The amount of movement referred to in this example is one example of the parameters of the present disclosure.

The data calculation module 255 acquires the tilt angle of the shoulders calculated by the attitude data detection module 251 and calculates, as the amount of movement, the sum of the tilt angles of the shoulders 51 acquired in one minute. For example, in the case that the user, from a forward-facing state, tilts their shoulders 51 20° to the right and then tilts their shoulders 51 10° to the left in one minute, the data calculation module 255 calculates the sum of the tilt angles of the shoulders 51 of the user as an amount of movement=30°. As shown in FIG. 11, the data calculation module 255 outputs this calculated amount of movement to the attitude data correction module 252.

The operation of the data calculation module 255 will be described with reference to FIG. 12. The operation of the data calculation module 255 shown in FIG. 12 is one example, with no implied limitation. In addition, the data calculation module 255 can calculate the tilt angle of the shoulders over one minute periodically, for example, every 30 minutes.

The data calculation module 255 acquires the tilt angle of the shoulders from the attitude data detection module 251 (S11). If one minute has not passed since the calculation of the tilt angle of the shoulders 51 over one minute has started (S12: No), the data calculation module 255 adds the acquired shoulder tilt angles (S13). The data calculation module 255 then returns to the process of S11. If one minute has passed since the calculation of the tilt angle of the shoulders 51 over one minute has started (S12: Yes), the data calculation module 255 outputs the computed sum of the angles to the attitude data correction module 252 (S14).

S13 can be placed ahead of the determination step of S12. In this case, if one minute has not passed since the calculation of the tilt angle of shoulders 51 over one minute has started, the operation proceeds to S11.

From the amount of movement received from the data calculation module 255, the attitude data correction module 252 selects a table with the corresponding pattern. In the example shown in FIG. 10, the attitude data correction module 252 selects from the three pattern tables p1, p2, p3, the table with the pattern that corresponds to the received amount of movement.

In this example, if the amount of movement is less than a threshold value th1 (for example, 30°), the attitude data correction module 252 selects table p1 with pattern 1. If the amount of movement is greater than or equal to the threshold value th1 and less than a threshold value th2 (for example, 120°), the attitude data correction module 252 selects table p2 with pattern 2. And if the amount of movement is greater than or equal to the threshold value th2, the attitude data correction module 252 selects table p3 with pattern 3.

For example, if the amount of movement is 25°, which is less than threshold value th1, the attitude data correction module 252 selects table p1 with pattern 1. The attitude data correction module 252 corrects the tilt angle of the shoulders so as to be the head angle based on table p1 with pattern 1.

In this manner, the shoulder-mounted speaker 1A of Modified Example 1 selects the table with the pattern that corresponds to the amount of movement and acquires the head angle form the selected table. The shoulder-mounted speaker 1A of Modified Example 1 thus uses a table suited to each user, in accordance with individual differences, and thereby acquires the head angle. Therefore, the shoulder-mounted speaker 1A of Modified Example 1 is able to localize the sound image more accurately.

An example in which the shoulder-mounted speaker 1A acquires the head angle from a table with a pattern that corresponds to the number of movements of the shoulders 51 per unit time (number of times the shoulders tilt) will now be described.

For example, the number of movements of the shoulders 51 per unit time (for example, in one minute) differs for each person. Even at the same tilt angle of the shoulders, the corresponding head angle will differ for a person who moves their shoulders 51 less often over one minute than a person who moves their shoulders 51 more often over one minute. For example, the head angle relative to the tilt angle of the shoulders will be greater for a person who makes a large number of movements than a person who makes a small number of movements. Thus, the shoulder-mounted speaker 1A calculates the total number of tilting movements of the shoulders 51 over one minute (hereinafter referred to as the number of movements per minute). The shoulder-mounted speaker 1A uses a table of patterns that correspond to the number of movements per minute and in this way corrects the tilt angle of the shoulders 51 so as to be the head angle.

Based on the data received from the attitude data detection module 251, the data calculation module 255 calculates the number of movements of the shoulders 51 per minute. For example, when the data calculation module 255 acquires, from the attitude data detection module 251, the tilt angle of the shoulders with the user's tilting of the shoulders to the right five times and to the left six times in one minute, the data calculation module 255 calculates the number of movements per minute of the shoulders 51 as 11 times. The data calculation module 255 outputs the calculated number of movements per minute to the attitude data correction module 252.

The attitude data correction module 252 selects a table with a pattern that corresponds to the number of movements per minute. Further, based on the table with the pattern that corresponds to the number of movements per minute, the attitude data correction module 252 corrects the tilt angle of the shoulders (for example, the shoulder tilt angle a1 directing as shown in FIG. 5) calculated by the attitude data detection module 251 so as to be the head angle.

Here, it is assumed that the tables are categorized in accordance with the number of movements per minute. That is, each of the tables p1, p2, p3 is categorized in accordance with the number of movements per minute. For example, table p1 is categorized in accordance with less than five movements per minute. Table p2 is categorized in accordance with five or more but less than ten movements per minute. Table p3 is categorized in accordance with ten or more movements per minute.

If the number of movements per minute is less than a threshold value th1 (for example, five times), the attitude data correction module 252 selects table p1 with pattern 1. In addition, if the number of movements per minute is greater than or equal to the threshold value th1 and less than a threshold value th2 (for example, ten times), the attitude data correction module 252 selects table p2 with pattern 2. In addition, if the number of movements per minute is greater than or equal to the threshold value th2, the attitude data correction module 252 selects table p3 with pattern 3.

In this manner, the shoulder-mounted speaker 1A of Modified Example 1 can select a table with the pattern that corresponds to the number of movements per minute and acquire the head angle from the selected table. In this case as well, the shoulder-mounted speaker 1A of Modified Example 1 can thus use a table suited to each user, in accordance with individual differences, to acquire the head angle. Therefore, the shoulder-mounted speaker 1A of Modified Example 1 is able to localize the sound image more accurately.

In Modified Example 1, the unit time was described as one minute, but the unit time can be longer or shorter than one minute. Further, the table can be categorized in accordance with both the amount of movement and the number of movements. In this case, the shoulder-mounted speaker 1A calculates both the amount of movement and the number of movements and selects a table with a corresponding pattern.

In addition, the shoulder-mounted speaker 1A of Modified Example 1 can use a table with a pattern corresponding to the genre of the content and acquire the head angle. The head angle with respect to the tilt angle of the shoulders differs depending on the genre of the content, such as games, TV images (including DVDs, etc.), and music, even for the same user. Thus, even the same tilt angle of the shoulders can result in a different head angle depending on the genre of the content that is viewed by the user. For example, noisy music like rock results in a greater head angle relative to the tilt angle of the shoulder, compared with quiet music, such as classical music. In such cases, the shoulder-mounted speaker 1A of Modified Example 1 can select a suitable table corresponding to the genre of the content and perform a more accurate sound image localization process. Information indicating the genre of the content can be acquired from a smartphone, for example. In this case, the shoulder-mounted speaker 1A of Modified Example 1 receives information from a smartphone via the communication unit 21.

Modified Example 2

Figure 13:
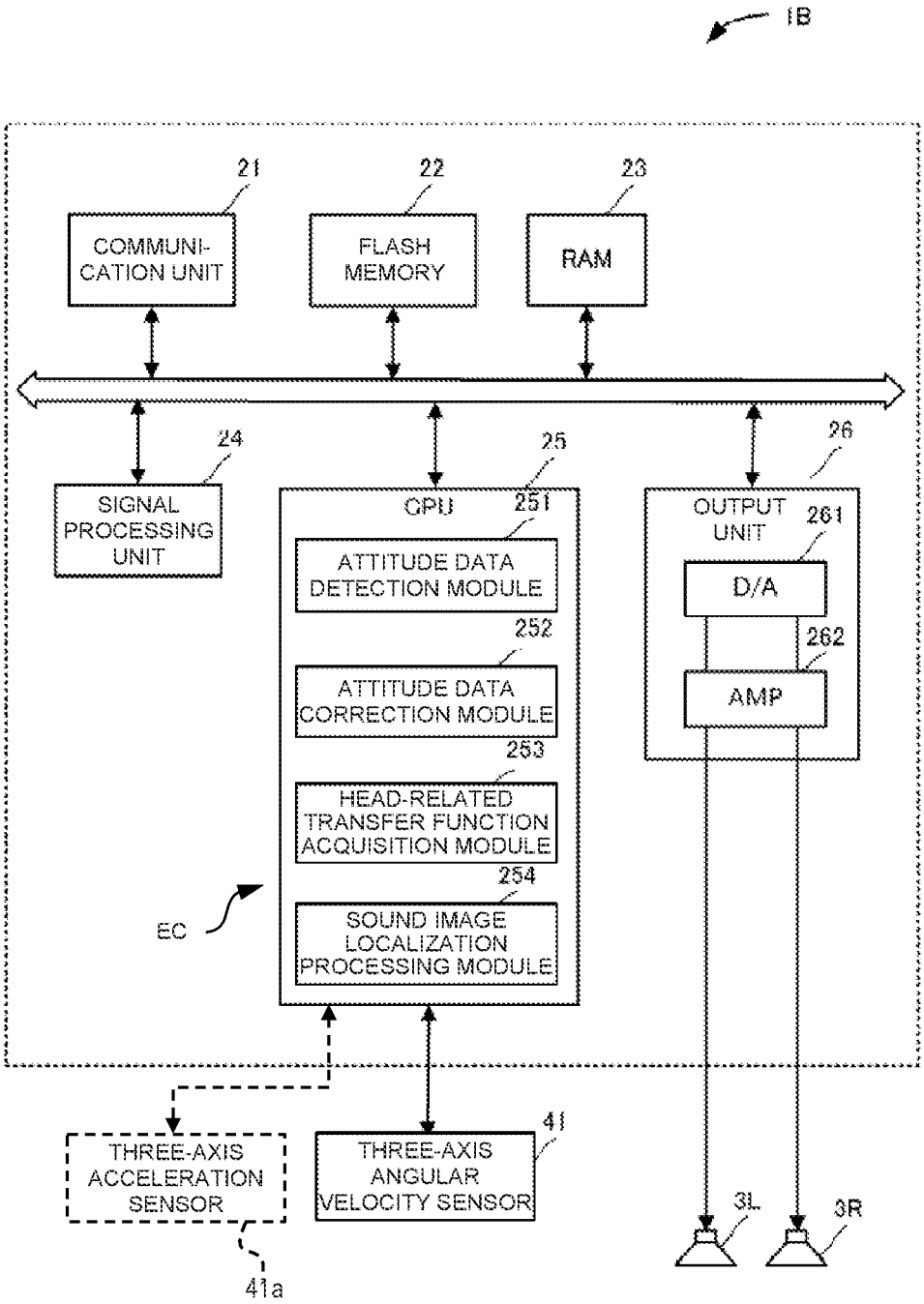
FIG. 13 is a block diagram showing the configuration of the shoulder-mounted speaker according to Modified Example 2.
Figure 15:
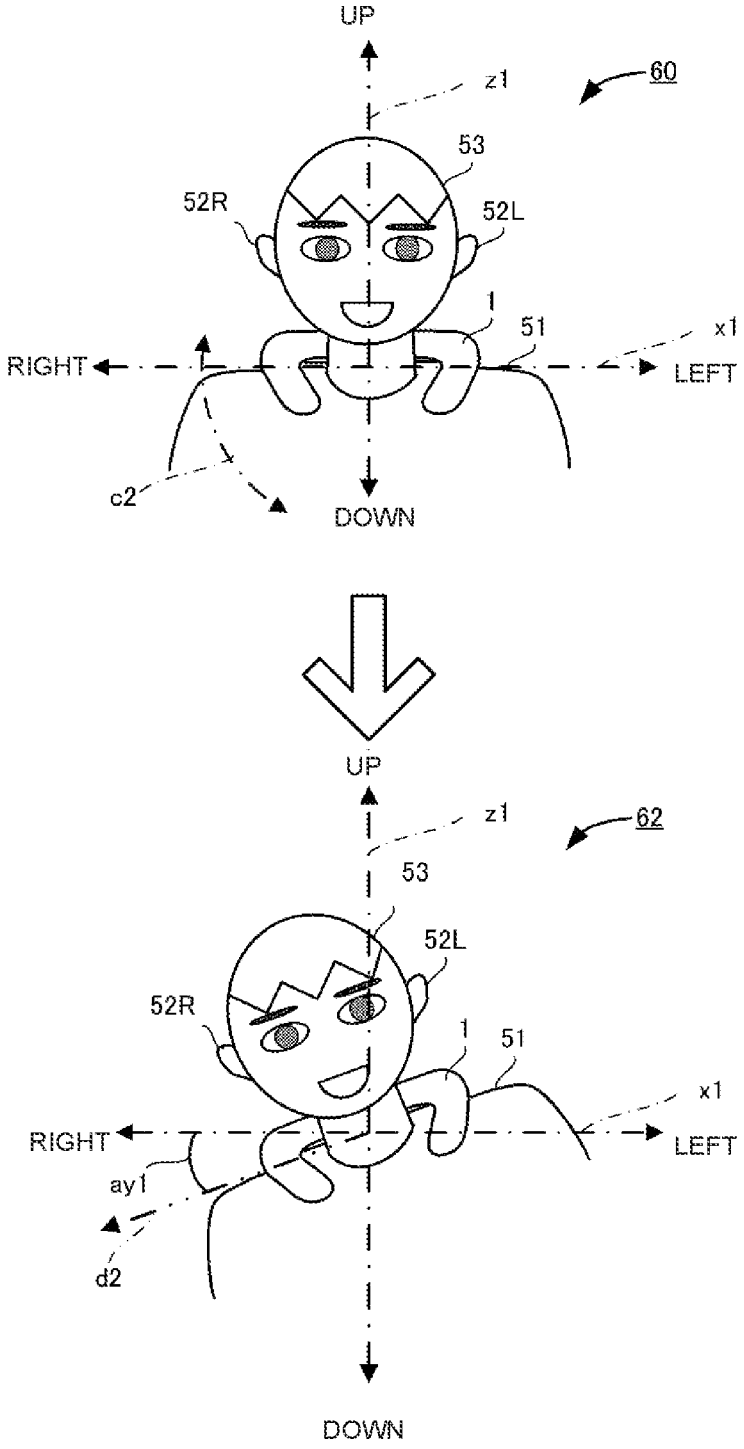
FIG. 15 is a front view of the shoulder-mounted speaker as seen from the front side of the user, showing a change in the user's state.
Figure 16:
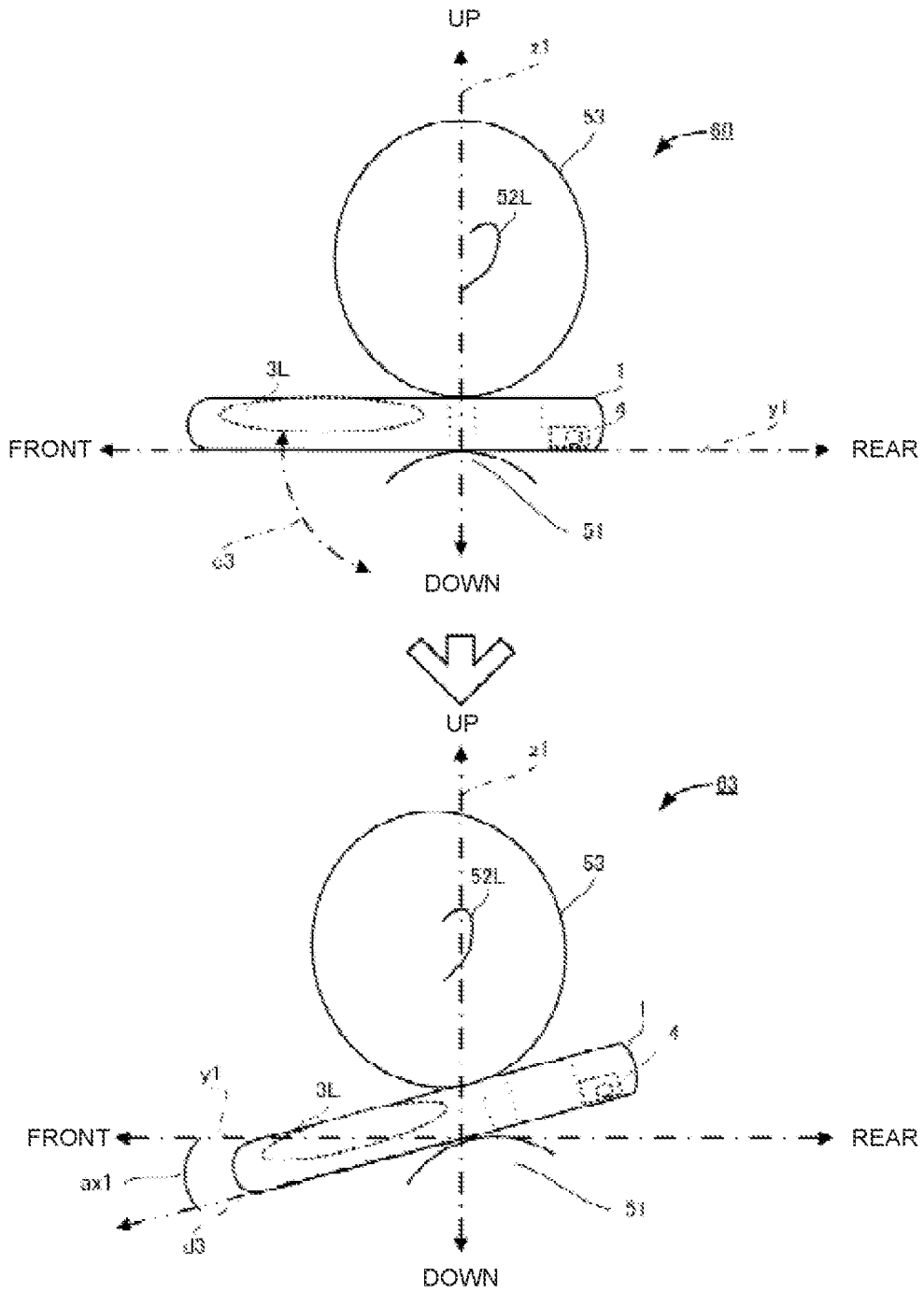
FIG. 16 is a side view of the shoulder-mounted speaker as seen from the left side of the user, showing a change in the user's state.

A shoulder-mounted speaker 1B of Modified Example 2 will be described with reference to FIGS. 13, 14, 15, and 16. FIG. 13 is a block diagram showing the configuration of the shoulder-mounted speaker 1B according to Modified Example 2. FIG. 14 illustrates tables ta1, ta2, and ta3, showing the relationships between the tilt angle of the shoulders and the head angle in three axial directions (vertical axis (yaw axis), front-rear axis (roll axis), and right-left axis (pitch axis)). FIG. 15 is a front view of the shoulder-mounted speaker 1B as seen from the front side of the user, showing a change in the state of the user. FIG. 16 is a side view of the shoulder-mounted speaker 1B as seen from the user's left, showing a change in the state of the user.

The shoulder-mounted speaker 1B of Modified Example 2 differs from the above-described example in that the tilt angle of the shoulders is corrected so as to be the head angle in accordance with the movement in the three axial directions (vertical axis, front-rear axis, and right-left axis). Configurations that are the same as those of the embodiment described above have been assigned the same reference symbols, and their descriptions have been omitted.

As shown in FIG. 13, the shoulder-mounted speaker 1B of Modified Example 2 is equipped with a three-axis angular velocity sensor 41. The three-axis angular velocity sensor 41 detects the angular velocity of the tilting of the shoulders 51 in horizontal direction c1 with the vertical direction as the axis (vertical axis). In the case that the orientation of the shoulders tilts from the right direction in FIG. 5 to the direction indicated by the chain double-dashed line d1, the attitude data detection module 251 detects, based on the angular velocity detected by the three-axis angular velocity sensor 41, the shoulder tilt angle a1 (refer to FIG. 5). As shown in FIG. 15, the three-axis angular velocity sensor 41 detects the angular velocity of the tilt of the shoulders 51 in rotation direction c2 with the front-rear direction (direction y1) as the axis (front-rear axis). In the case that the orientation of the shoulders tilts from the right direction in FIG. 15 toward the direction indicated by the chain double-dashed line d2, the attitude data detection module 251 calculates a shoulder tilt angle ay1 based on the angular velocity detected by the three-axis angular velocity sensor 41. As shown in FIG. 16, the three-axis angular velocity sensor 41 detects the angular velocity of the tilt of the shoulders 51 in rotation direction c3 with the right-left direction (direction x1) as the axis (right-left axis). In the case that the orientation of the shoulders tilts from the front direction towards the direction indicated by the chain double-dashed line d3, the attitude data detection module 251 calculates a shoulder tilt angle ax1 based on the angular velocity detected by the three-axis angular velocity sensor 41.

The shoulder tilt angle a1 in horizontal direction c1 was described in relation to the above-described embodiment, so that a detailed description will be omitted.

Table ta1 with corresponding shoulder tilt angles a1 (see FIG. 5) which are tilted with respect to the vertical axis (horizontal direction c1), table ta2 with corresponding tilt angles ay1 (see FIG. 15) of the shoulders 51 which are tilted with respect to the front-rear axis, and table ta3 with corresponding shoulder tilt angles ax1 (see FIG. 16) of the shoulders 51 tilted from the right-left axis are stored in the flash memory 22.

Tables ta2 and ta3, like table ta1, are the mean values of a large amount of measurement data. Moreover, tables ta2 and ta3 can be generated by using a machine-learned algorithm, such as a neural network.

The attitude data detection module 251 outputs the calculation result to the attitude data correction module 252.

The attitude data correction module 252 receives shoulder tilt angle a1 and then acquires the head angle from table ta1 with the corresponding shoulder tilt angle a1. Further, the attitude data correction module 252 receives shoulder tilt angle ay1 and then acquires the head angle from table ta2 with the corresponding shoulder tilt angle ay1. Further, the attitude data correction module 252 receives shoulder tilt angle ax1 and then acquires the head angle from table ta3 with the corresponding shoulder tilt angle ax1.

The head-related transfer function acquisition module 253 reads the head-related transfer functions that correspond to the head angle in the vertical axis, the front-rear axis, and the right-left axis, and outputs the head-related transfer functions to the sound image localization processing module 254. Alternatively, the head-related transfer function acquisition module 253 calculates the head-related transfer functions that corresponds to the head angle in the vertical axis, the front-rear axis, and the right-left axis, and outputs the head-related transfer functions to the sound image localization processing module 254.

The shoulder-mounted speaker 1B of Modified Example 2 can acquire the tilt of the shoulders 51 in three axial directions from the three-axis angular velocity sensor 41 and thus localize a more accurate and more three-dimensional sound image.

The description of the present embodiment is merely exemplary in all respects and should not be considered restrictive. The scope of the present invention is as defined by the Claims, and not by the embodiments described above. Furthermore, the scope of the present invention is intended to include all variations, modifications, or equivalents as fall within the scope of the claims.

The shoulder-mounted speaker can be equipped with a three-axis acceleration sensor 41*a* instead of the sensor 4 or the three-axis angular velocity sensor 41 (FIG. 13). The shoulder-mounted speaker can obtain the rotation angle of each axis based on the acceleration detected by the three-axis acceleration sensor 41*a*. Further, the shoulder-mounted speaker can be equipped with both the angular velocity sensor 41 and the three-axis acceleration sensor 41*a*, as seen in FIG. 13. In this case, the shoulder-mounted speaker can correct the rotation angle calculated based on the detected value of the angular velocity sensor 41 using the detected value of the three-axis acceleration sensor 41*a* and thereby localize the sound image with greater precision.

It is not necessary for the shoulder-mounted speaker to use a table to correct the tilt angle of the shoulders so as to be the head angle. The attitude data correction module 252 can correct the tilt angle of the shoulders so as to be the head angle based on a function indicating the relationship between the tilt angle of the shoulders and the head angle. The shoulder-mounted speaker calculates the head angle using such a function; thus, it is possible to increase the detection accuracy of the head angle.

The plurality of patterns described in Modified Example 1 need not be associated with at least one parameter from among the amount of movement (speed) or the number of movements per unit time.

The shoulder-mounted speaker 1A of Modified Example 1 can be configured to be equipped with a user interface for receiving a user operation to thereby receive an operation from the user. In this case, the shoulder-mounted speaker 1A is equipped with a display unit that displays a plurality of patterns. The display unit displays a pattern A for people that make large movements and a pattern B for people that make small movements. The shoulder-mounted speaker 1A corrects the tilt angle of the shoulders so as to be the head angle based on a table of pattern selected by the user. The shoulder-mounted speaker 1A can thereby localize a sound image preferred by the user.

The shoulder-mounted speaker 1A can be configured to select a pattern based on information input by the user, such as gender and age group. For example, the shoulder-mounted speaker 1A prepares a pattern A for people younger than 20, a pattern B for people over 20 and younger than 40, and a pattern C for people 40 or older. In this case, the shoulder-mounted speaker 1A selects the table of pattern A if the input information is a male younger than 20. In addition, the shoulder-mounted speaker 1A selects the table of pattern B if the input information is for a male 20 or older and younger than 40.

The processing relating to sound image localization can be carried out by a mobile terminal that transmits audio signals. In this case, the shoulder-mounted speaker transmits the sensor's detection signal to the mobile terminal via the communication unit 21 and receives the stereo audio signal subjected to sound image localization processing on the mobile terminal.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts unless otherwise stated.

As used herein, the following directional terms "forward", "rearward", "front", "rear", "up", "down", "above", "below", "upward", "downward", "top", "bottom", "side", "vertical", "horizontal", "perpendicular" and "transverse" as well as any other similar directional terms refer to those directions of a shoulder-mounted speaker on the shoulders of a user. Accordingly, these directional terms, as utilized to describe the shoulder-mounted speaker should be interpreted relative to a user in an upright position on a horizontal surface. The terms "left" and "right" are used to indicate the "right" when referencing from the right side as viewed from the rear of the user, and the "left" when referencing from the left side as viewed from the rear of the user.

The phrase "at least one of" as used in this disclosure means "one or more" of a desired choice. For one example, the phrase "at least one of" as used in this disclosure means "only one single choice" or "both of two choices" if the number of its choices is two. For another example, the phrase "at least one of" as used in this disclosure means "only one single choice" or "any combination of equal to or more than two choices" if the number of its choices is equal to or more than three. Also, the term "and/or" as used in this disclosure means "either one or both of".

The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives. Finally, terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A shoulder-mounted speaker, comprising an electronic controller including at least one processor, the electronic controller being configured to execute a plurality of modules including an attitude data detection module that is configured to detect an attitude of a body region on which the shoulder-mounted speaker is placed and is configured to acquire body region attitude data obtained by digitizing the attitude of the body region, an attitude data correction module that is configured to correct the acquired body region attitude data so as to be head attitude data, and a sound image localization processing module that is configured to use a head-related transfer function that corresponds to the head attitude data corrected by the attitude data correction module to subject an audio signal to sound image localization processing.

2. The shoulder-mounted speaker according to claim 1, wherein the attitude data correction module is configured to correct the body region attitude data so as to be the head attitude data based on a table indicating a relationship between the body region attitude data and the head attitude data.

3. The shoulder-mounted speaker according to claim 2, wherein the table is categorized into a plurality of patterns, and the attitude data correction module is configured to receive a selection of one pattern from among the plurality of patterns and is configured to correct the body region attitude data so as to be the head attitude data based on the table of the received pattern.

4. The shoulder-mounted speaker according to claim 3, wherein the electronic controller is configured to further execute a data calculation module that is configured to calculate, from the body region attitude data acquired by the attitude data detection module, at least one parameter from an amount of movement of a user per unit time or a number of movements of the user per unit time, the plurality of patterns being associated with the parameter, and the attitude data correction module being configured to correct the body region attitude data so as to be the head attitude data based on the table with a pattern that corresponds to the calculated parameter.

5. The shoulder-mounted speaker according to claim 1, wherein the attitude data correction module is configured to correct the body region attitude data so as to be the head attitude data based on a function indicating a relationship between the body region attitude data and the head attitude data.

6. The shoulder-mounted speaker according to claim 1, wherein the attitude data correction module is configured to correct an angle of the body region in a horizontal plane about an axis along a vertical direction so as to be a head angle.

7. The shoulder-mounted speaker according to claim 1, wherein the attitude data detection module is configured to detect the attitude of the body region from at least one of a three-axis angular velocity sensor and a three-axis acceleration sensor.

8. A sound image localization method comprising:

detecting an attitude of a body region on which a shoulder-mounted speaker is placed, acquiring body region attitude data obtained by digitizing the attitude of the body region;

correcting the acquired body region attitude data so as to be head attitude data, and using a head-related transfer function that corresponds to the corrected head attitude data to subject an audio signal to sound image localization processing, the body region attitude data being corrected so as to be the head attitude data based on a table indicating a relationship between the body region attitude data and the head attitude data.

9. The sound image localization method according to claim 8, wherein the table is categorized into a plurality of patterns, a selection of one pattern from among the plurality of patterns is received, and the body region attitude data is corrected so as to be the head attitude data based on the table of the received pattern.

10. The sound image localization method according to claim 9, wherein at least one parameter from an amount of movement of a user per unit time or a number of movements of the user per unit time is calculated from the acquired body region attitude data, the plurality of patterns are associated with the parameter, and the body region attitude data is corrected so as to be the head attitude data based on a table with a pattern that corresponds to the calculated parameter.

11. The sound image localization method according to claim 8, wherein an angle of the body region in a horizontal plane about an axis along a vertical direction as the axis is corrected so as to be a head angle.

12. The sound image localization method according to claim 8, wherein the attitude of the body region is detected from at least one of a three-axis angular velocity sensor and a three-axis acceleration sensor.

13. A non-transitory computer-readable medium storing a program that causes a computer to execute a process, the process comprising:

detecting an attitude of a body region on which a shoulder-mounted speaker is placed;

acquiring body region attitude data obtained by digitizing the attitude of the body region;

correcting the acquired body region attitude data so as to be head attitude data; and using a head-related transfer function that corresponds to the corrected head attitude data to subject an audio signal to sound image localization processing, the body region attitude data being corrected so as to be the head attitude data based on a table indicating a relationship between the body region attitude data and the head attitude data.

* * * * *